US005862556A

United States Patent [19]

Aubert

[11] Patent Number: 5,862,556

[45] Date of Patent: Jan. 26, 1999

[54] BRIDGING SPAN STRUCTURE

[75] Inventor: Henri Aubert, Sanary, France

[73] Assignee: Constructions Industrielles de la Mediterranee -CNIM, Paris, France

[21] Appl. No.: 809,790

[22] PCT Filed: Jul. 31, 1996

[86] PCT No.: PCT/FR96/01212

§ 371 Date: Mar. 28, 1997

§ 102(e) Date: Mar. 28, 1997

[87] PCT Pub. No.: WO97/05332

PCT Pub. Date: Feb. 13, 1997

[30] Foreign Application Priority Data

Aug. 2, 1995 [FR] France ..... 95 09432

[51] Int. Cl.[6] ..... E01D 15/12; E01D 15/10

[52] U.S. Cl. ..... 14/2.4; 14/2.5

[58] Field of Search ..... 14/2.4, 2.5, 2.6

[56] References Cited

U.S. PATENT DOCUMENTS 3,713,599 1/1973 Smith et al. ..... 242/7.11
4,393,533 7/1983 Terrien et al. ..... 14/2.6
4,411,037 10/1983 Terrien et al. ..... 14/2.6

FOREIGN PATENT DOCUMENTS 0374019 6/1990 European Pat. Off. .
2158618 6/1973 France .
2683837 5/1993 France .
2251448 7/1992 United Kingdom .

*Primary Examiner*—Tamara L. Graysay
*Assistant Examiner*—Sunil Singh
*Attorney, Agent, or Firm*—Leydig, Voit & Mayer

[57] ABSTRACT

A bridging span structure for the crossing of ditches by vehicles has a locking mechanism for locking an upwards swingable access jib to a central box of a bridging span element. The locking mechanism includes at least two tie-rod elements pivotally connected to the access jib by two stationary transverse shafts, and two transverse locking shafts with a controlled displacement permitting fastening of both tie-rod elements to the central box in two different positions, respectively, corresponding to lower and upwards swung positions, respectively, of the upwards swingable access jib, the invention being usable in particular by the Engineering Corps.

17 Claims, 6 Drawing Sheets

BRIDGING SPAN STRUCTURE

BACKGROUND OF THE INVENTION

The present invention relates to a bridging span structure intended in particular for the crossing of ditches by vehicles such as armoured vehicles of the Engineer Corps.

The document FR-B-2,683,837 in the name of the applicant describes a bridging span structure disposed on a transport vehicle so as to be laid down alone or in association with an identical bridging span structure over a ditch by a suitable lay-down system mounted onto the transport vehicle.

SUMMARY OF THE INVENTION

The present invention has the purpose of improving the bridging span structure described in the hereabove document by providing a bridging span structure permitting the forces applied thereon or on an end-to-end assembly of bridging span structures during the launching phase of the bridging span structure or of the assembled bridging span structures above the ditch to be crossed or during the passage of vehicles upon the bridging span structure or the assembled bridging span structures disposed over across the ditch to be better sustained.

For that purpose, the invention proposes a bridging span structure intended in particular to the crossing of ditches by vehicles such as armoured vehicles of the Engineer Corps formed of at least one bridging span element comprising a rigid central box with an upper treadway and two access jibs assembled to both ends of the central box so as to extend the trackway of the central box, at least one of the access jibs being fastened to the central box on the one hand by a transverse pivot pin and on the other hand by unlockable locking means allowing the access jib to assume a lower position bearing upon one edge of a ditch or an upper or raised position for being coupled to an access jib of another bridging span element. The locking means comprise at least two elements forming parallel tie-rods disposed symmetrically to the longitudinal axis of the bridging span element and pivotally connected to the access jib by two stationary transverse pins, and two transverse locking shafts with a controlled displacement permitting the fastening of both tie-rod elements to the central box in two different positions corresponding to the lower and raised positions, respectively, of the access jib.

Preferably the pivot pin of the liftable access jib is located at the lower portion thereof and the locking means of this jib are located at the upper portion of the jib and of the central box.

The transverse locking shafts are movably mounted into two bores of the central box and may be each inserted into one of two bores of the corresponding tie-rod element defining both lower and raised positions of the access jib.

Preferably the means for the control of the displacement of both transverse locking shafts comprise a transverse shaft rotatably mounted into a casing made fast to the central box, two threaded rods made fast to both ends of the rotary shaft coaxially therewith and onto each one of which is assembled an internally tapped sleeve constituting a transverse locking shaft, and a drive means for rotating the rotary shaft so as to displace in translation in opposite directions both sleeves from one unlocking position to a locking position of the tie-rod elements.

The drive means for rotating the rotary shaft comprises a drive rod extending through the central box and one end portion of which is mounted for rotation in the supporting casing of the rotary shaft and carries a bevel gear meshing with another bevel gear made fast to the rotary shaft, the other end of the drive rod being mechanically coupled to a sprocket pinion mounted for rotation onto the central box on one side thereof and operatively rotated by a transmission chain.

The other end of the drive rod is coupled to the rotary shaft of the side sprocket pinion by a Cardan joint.

The locking shaft of a corresponding tie-rod element extends through the bore defining the lifted position of the access jib with a clearance permitting to bring into abutment the bearing front faces of the access jib and of the central box during the passage of vehicles upon the bridging span element.

The bridging span structure also comprises means for locking the upwards swingable access jib of the bridging span element onto a stationary access jib of another adjacent bridging span element for assembling both bridging span elements together and comprising on either side of the upwards swingable access jib, a horizontal link mounted onto the pivot pin of the upwards swingable access jib through the medium of a ball-and-socket joint and fastened to the central box through the medium of an elastic stop, a vertical link connected to the upwards swingable jib through the medium of a spherical stop and to the horizontal link through the medium of a bush permitting the passage of a controlled slidable transverse locking pin disposed on one side of the stationary access jib of the other bridging span element at the end thereof, so that in the locked position of the upwards swung access jib of the bridging span element upon the stationary access jib of the other bridging span element, each spherical stop and each elastic stop absorb the side forces exerted upon the assembled bridging span elements during the launching of these elements over a ditch and each vertical link takes up the vertical forces located at the end of the stationary access jib during the passage of vehicles upon the assembled bridging span elements.

Preferably the spherical stop comprises a nut with a spherical bearing portion screwed onto the threaded end of the vertical link and bearing upon a complementary spherical surface of a base fastened onto a supporting portion made fast to the upwards swingable jib, the upper portion of the vertical link extending through the supporting portion and the base.

Preferably the elastic stop is fastened between the central box and a radial lug made fast to the horizontal link at the level of its pivotal connection to the central box.

Preferably the means for the control of the displacement of both transverse pins of the stationary access jib of a bridging span element comprise a transverse shaft mounted for rotation in a casing made fast to the end of the stationary jib, two threaded rods made fast to both ends of the rotary shaft coaxially therewith and onto each one of which is assembled an internally tapped sleeve constituting a transverse locking shaft, and a drive means for rotating the rotary shaft so as to displace in translation in opposite directions both sleeves from one unlocking position to a locking position of the end of the stationary access jib from and to connecting bushes of both horizontal and vertical links of an upwards swung access jib.

The drive means for rotating the rotary shaft comprises a drive rod extending through the stationary access jib and one end portion of which is mounted for rotation in the supporting casing of the rotary shaft and carries a bevel gear meshing with another bevel gear made fast to the rotary shaft, the other end of the drive rod being mechanically coupled to a sprocket pinion mounted for rotation onto the stationary jib on one side thereof and driven for being rotated by a transmission chain.

The other end of the drive rod is coupled to the rotary pin of the side sprocket wheel by a Cardan joint.

The end of the upwards swingable jib of the bridging span element is fastened to the stationary access jib of the other bridging span element by two hook-shaped parallel portions made fast to the stationary access jib in the vicinity of the edges thereof and engaging two longitudinal notches, respectively, provided at the end of the upwards swingable access jib.

The stationary access jib of the other bridging span element comprises two square-shaped side stops made fast to the end of the stationary access jib and transversely keeping the corresponding portion of the upwards swingable access jib in bearing relationship upon the stationary access jib.

The bridging span structure comprises two bridging span elements with upper parallel treadways and the central boxes of which are connected to each other by two connecting arms and both access jibs forward of or behind both bridging span elements are stationary and upwards swingable, respectively.

BRIEF DESCRIPTION OF THE DRAWINGS

The invention will be better understood and further objects, characteristics, details and advantages thereof will appear more clearly in the explanatory description which will follow made with reference to the attached diagrammatic drawings given by way of example only, illustrating an embodiment of the invention and in which.

DESCRIPTION OF PREFERRED EMBODIMENTS

Figure 1:
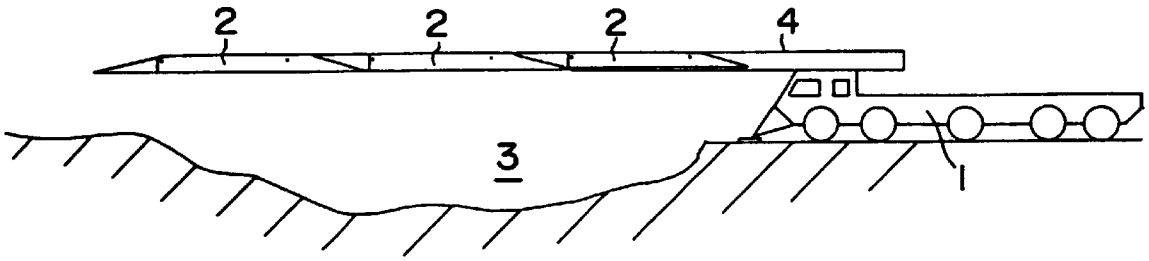
FIG. 1 is a diagrammatic view showing a vehicle for laying down a bridging span above a ditch and consisting of several bridging span structures according to the invention.

FIG. 1 shows a road vehicle 1 such as a truck arranged for carrying at least one bridging span 2 to be near a ditch 3 for laying it down over the latter. This figure shows that three bridging spans 2 have been coupled end-to-end by a laying-down system (not shown in detail) in particular with a launching beam 4 mounted on the vehicle 1 and assuming a position for launching the latter above the ditch 3.

The system for laying down the bridging spans 2 is described in detail in the document FR-A-2,683,837.

As shown in particular from FIGS. 2 to 11, each bridging span 2 comprises two identical parallel bridging span elements 5 only one of which is shown, connected together by connecting arms forming braces 6 partially shown. Each bridging span element 5 comprises a central rigid body or box 7 with an upper trackway or treadway 8 and two access jibs 9, 10 assembled to both ends, respectively, of the central box 7 so as to extend the upper trackway of this box. Access jib 10 is stationary whereas access jib 9 is fastened to the central box 7 at a place opposite to the stationary access jib 10 by a transverse a pivotal connection 11 permitting the jib 9 to assume either a lower position shown in particular in FIGS. 3 and 4 in which the bottom of the jib 9 is located in the same plane as the bottom of the central box 7, or an upper or upwards swung position shown in FIG. 5 in which the sloping bottom of the jib 9 with respect to that of the central box 7 may be assembled in bearing relationship to the adjacent top face of the stationary jib 10 of another bridging span element 5 for the purpose of providing a bridging span with a great length by the coupling of bridging span elements. The upwards swingable jib 9 of a bridging span element is held in either one of its lower and upwards swung positions by locking means 12 which will be described subsequently.

Both elements 5 of a bridging span 2 are assembled by their connecting arms 6 so that the bridging span 2 may have available at each one of its ends two access jibs, an upwards swingable one 9 and a stationary one 10 so that there be no imposing conditions for the direction of presentation of the bridging spans during their being coupled. Moreover each bridging span 2 comprises two pairs of riding rollers 13 fastened in confronting relationship to both mutually confronting internal side walls of the other one of two bridging span elements 5, respectively. The rollers 13 permit the guiding of the bridging span 2 upon the launching beam 4 during the procedure of laying down the bridging span or bridging spans coupled together as described in the document FR-A-2,683,837. To couple two bridging spans 2 end-to-end, each upwards swingable access jib 9 of one bridging span is fastened to the corresponding stationary jib 10 of the other bridging span by locking means which will also be defined subsequently.

According to the invention, the pivot pin 11 of the upward swingable access jib 9 of each bridging span element 5 is located at the lower portion of the jib 9 approximately in the same plane as that passing along the bottom of the central box 7 and the means 12 for locking the access jib 9 to the central box 7 are located at the upper portions thereof.

The locking means 12 comprise two pairs of elements forming tie-rods 14 arranged in parallel relationship and symmetrically with respect to the longitudinal axis of the bridging span element 5, both tie-rod elements 14 of one pair being mounted in pivotally connected relationship onto the access jib 9 through a stationary transverse pin 15 made fast to the jib 9 whereas both tie-rod elements 14 of the other pair are also mounted in pivotally connected relationship onto the access jib 9 through another stationary transverse pin 15 made fast to the jib 9 in coaxial relation to the foregoing pivot pin 15.

The locking means 12 also comprise two transverse locking shafts 16 mounted for controlled sliding into two coaxial bores (designated at 24 in FIG. 13), respectively, of the central box 7 and permitting each one to fasten two tie-rod elements 14 of a same pair in two different positions corresponding to the lower and upwards swung positions, respectively, of the access jib 9. For that purpose both tie-rod elements 14 each comprise two distinct bores 17, 18 defining both lower and upwards swung positions of the access jib 9 when the corresponding locking shaft 16 is inserted into either one of both bores 17, 18. Thus when the shaft 16 locks both tie-rod elements 14 of a same pair extending through both coaxial bores 17, the jib is fixed in the upwards swung position and when the shaft 16 locks these two tie-rod elements 14 extending through the other two coaxial bores 18, the jib 9 is fixed in the lower position.

Figure 13:
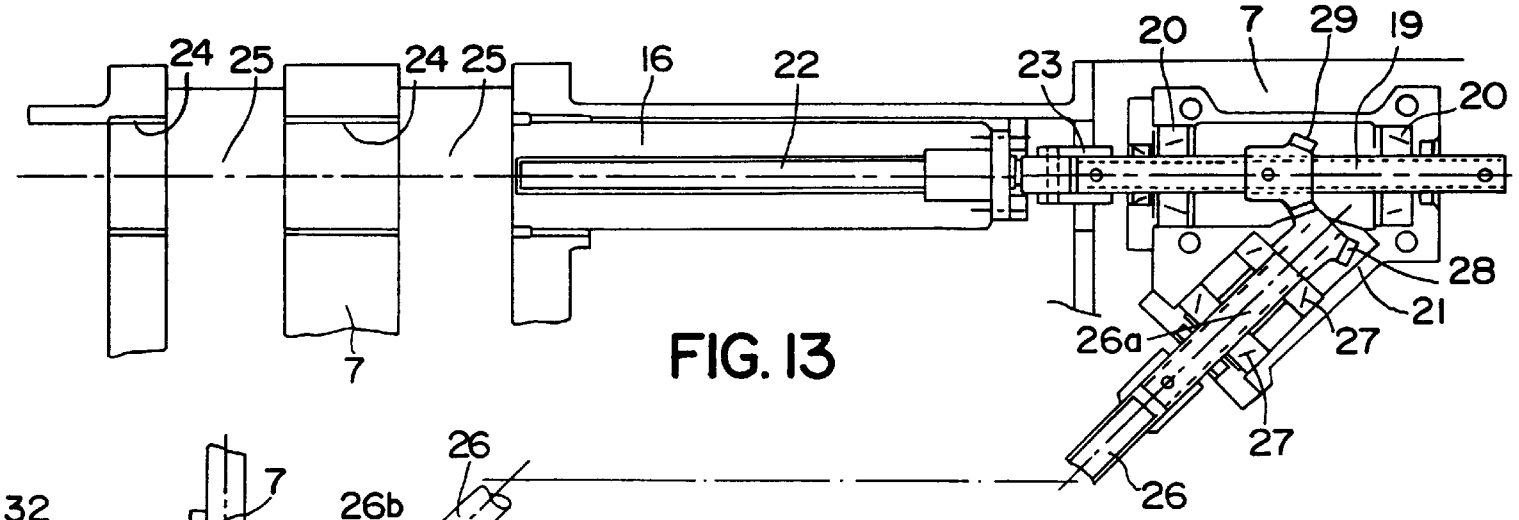
FIG. 13 is an enlarged view of the portion of bridging span element shown by arrow XIII of FIG. 2.

The control means permitting the displacement of both transverse locking shafts 16 from their locking position to their unlocking position or reversely comprise as shown in more detail in FIG. 13, a transverse shaft 19 mounted for rotation through the medium of bearings 20 for example of the needle bearing type within a casing 21 made fast to the central box 7, two threaded rods 22 made fast to both ends, respectively, of the rotary shaft 19 in coaxial relation thereto through the medium of a coupling sleeve 23 and on each one of which is assembled an internally tapped sleeve 16 constituting a transverse locking shaft. FIG. 13 shows the locking shaft 16 of one pair of tie-rod elements 14 in the retracted position for their being unlocked. This figure also shows two coaxial bores 24 provided in portions of the central box 7 defining two yokes 25 into which are inserted both tie-rod elements 14, respectively, of the same pair so as to be fastened to the central box 7 by the corresponding locking shaft 16. The shaft 19 may be driven for rotation by a mechanical mechanism comprising a drive rod 26 extending obliquely through the central box 7 and one end portion 26*a* of which is rotatably mounted in a supporting casing 21 for the shaft 19 through the medium of two bearings 27, for example of the needle bearing type and carries a bevel gear 28 meshing with another bevel gear 29 made fast to the rotary shaft 19 in the middle thereof, the other end 26*b* of the drive rod 26 being coupled to a shaft 30 rotatably mounted on the central box 7 through the medium of a coupling of the Cardan joint kind 31. The rotary shaft 30 carries a sprocket pinion 32 located on one side of the central box 7 outside thereof and onto which is mounted a transmission chain (not shown) driven at its end opposite to the sprocket pinion 32 by another sprocket pinion (not shown) itself driven by a drive member such as an electric motor for example made fast to the central box 7 at the bottom thereof.

Figure 6:
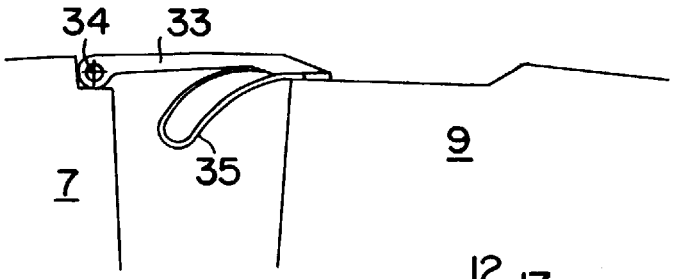
FIG. 6 is an enlarged view of the portion circled at VI in FIG. 3.

The upper locking means 12 are protected from external dirt such as mud by a protective transverse metal sheet 33 mounted by being pivotally connected to the central box 7 by a transverse shaft 34 extending over the whole width of this box and a rubber sealing joint 35 which, as this is better shown in FIG. 6, is in the shape of a folded strip having one end fastened underneath the protective metal sheet 33 and its other end fastened to the upper part of the upwards swingable jib 9 upon which the protective metal sheet 33 is caused to bear.

The locking shafts 16 of the tie-rod elements 14 extend through the corresponding bores 17 with a clearance permitting the tie-rod elements 14 to be not acted upon by forces during the passage of vehicles over the bridging span in the working position as will be shown subsequently.

As previously mentioned, each bridging span element 5 also comprises means for locking the upwards swingable access jib 9 to the stationary access jib 10 of another adjacent bridging span element to form a bridging span of greater length.

Figure 12:
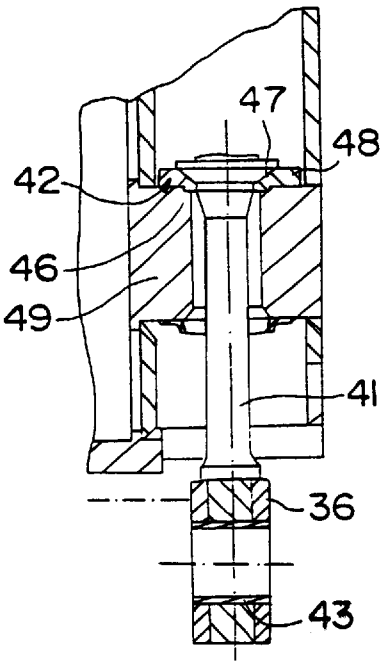
FIG. 12 is a view in section taken along line XII—XII of FIG. 11.
Figure 11:
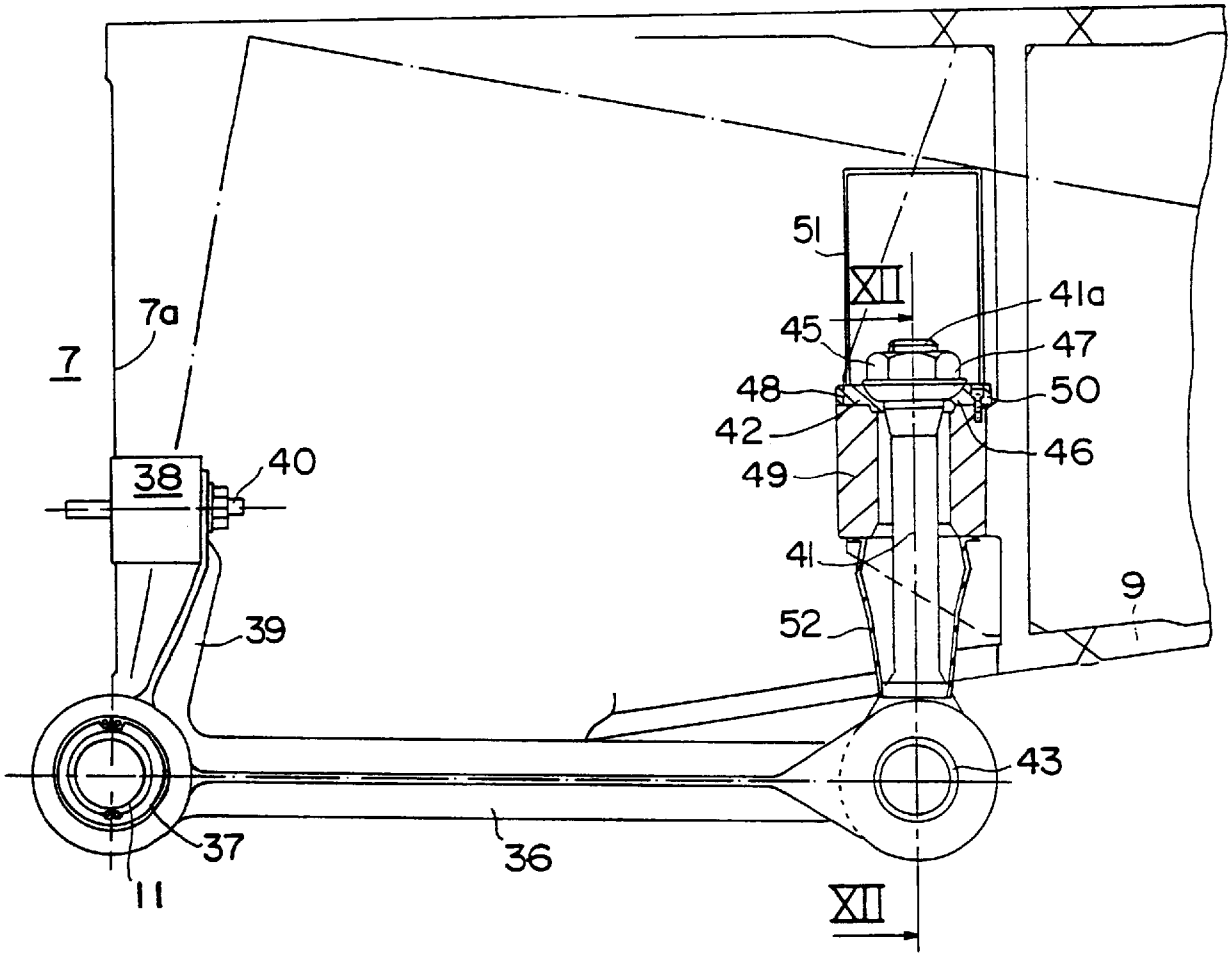
FIG. 11 is an enlarged view in partial section of the means permitting the locking of an upwards swingable jib of a bridging span element to a stationary jib of another bridging span element.

As better shown in FIGS. 11 and 12, these locking means comprise a horizontal link 36 mounted onto the pivot pin 11 of the upwards swingable access jib 9 through the medium of a ball-and-socket joint 37 and fastened to the central box 7 through the medium of an elastic stop 38 of elastomeric material mounted between the front wall 7*a* of the central box 7 and a radial lug 39 made fast to the horizontal link 36 at the level of its pivotal connection to the central box 7. The elastic stop 38 is fastened to the central box 7 and to the lug 39 by a stud 40 extending through the stop 38 and the lug 39 while being anchored in the box 7. The means for locking the upwards swingable access jib 9 to the stationary jib 10 also comprise a vertical link 41 connected to the upwards swingable jib 9 through the medium of a spherical stop 42 which will be described in detail and to the horizontal link 36 through the medium of a bush 43 permitting the passage of the corresponding one of two controlled sliding transverse locking shafts 44 arranged on both sides of the stationary access jib 10 of the other bridging span element 5 at the end thereof.

The spherical stop 42 comprises a nut 45 with a spherical bearing surface 46 screwed onto the threaded end 41*a* of the vertical link 41 and bearing upon a complementary spherical surface 47 of a base 48 fastened onto the supporting portion 49 made fast to the structure of the upwards swingable jib 9, the upper portion of the vertical link 41 extending through the supporting portion 49 and the base 48. The base 48 is fastened to the supporting portion 49 by fastening screws 50 one of which only is shown. The spherical stop 42 may be protected from the mud by an upper hood 51 fastened onto the base 48 by any suitable means, such as fastening screws and a protective rubber bellows 52 surrounding the lower portion of the vertical link 41 while being fastened in suitable and fluid-tight manner to the lower end of the vertical link 41 and underneath the supporting portion 49.

FIG. 11 shows the upwards swingable jib 9 in the lifted locking position before fastening onto a stationary jib 10 of another bridging span element 5 under these conditions, the set of the horizontal link 36 and the vertical link 41 is held in a proper presentation position and position of locking the upwards swung jib 9 to the stationary jib 10 of the other bridging span element assembled by the elastic stop 38.

Figure 2:
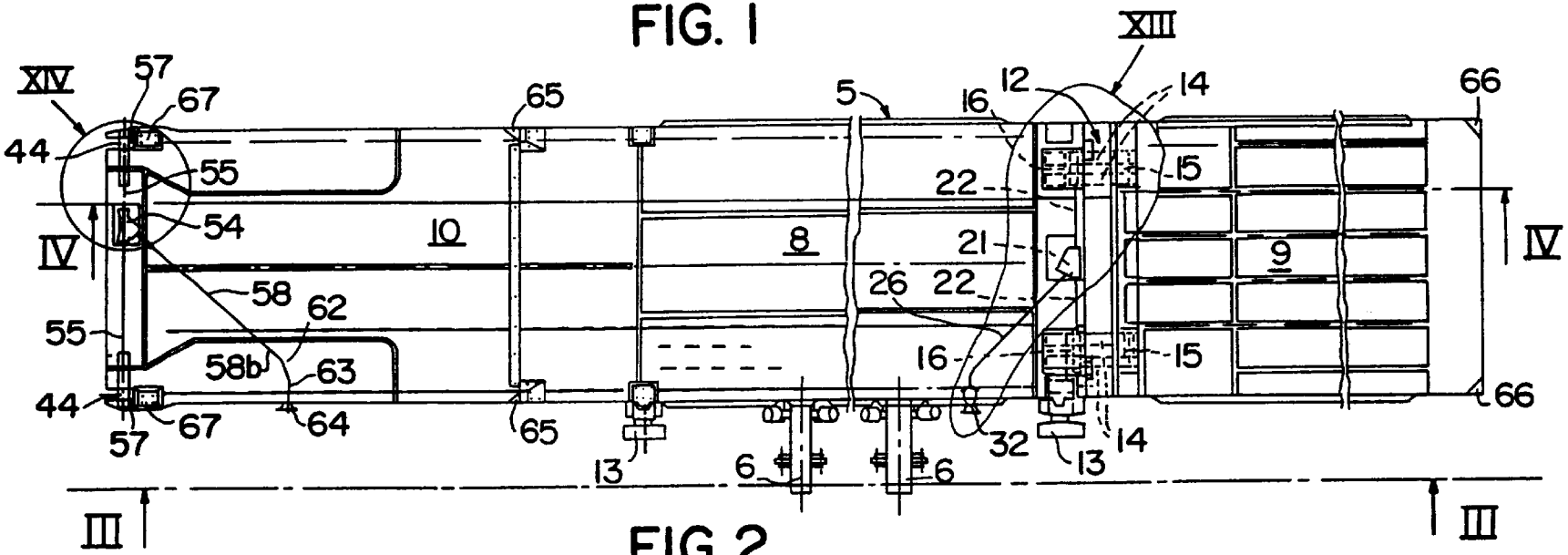
FIG. 2 is a detailed top view of a bridging span element of a bridging span structure of the invention.
Figure 3:
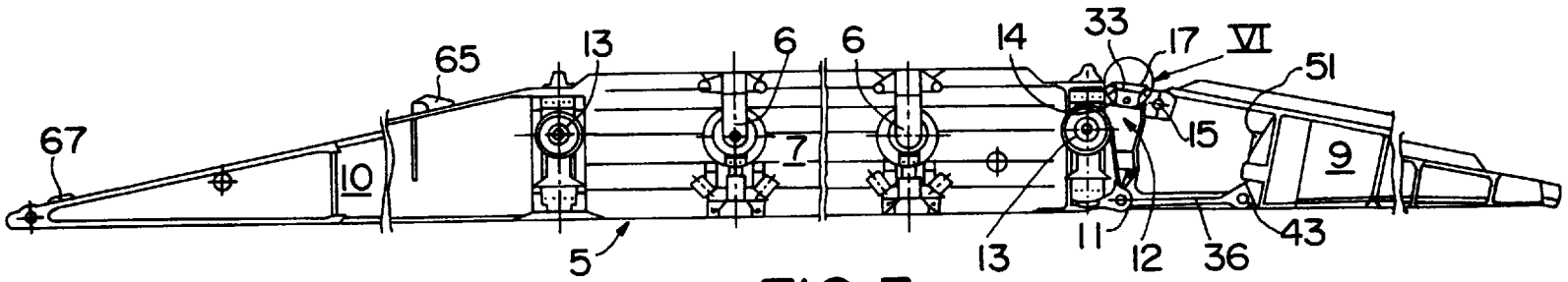
FIG. 3 is a view in section taken along line III—III of FIG. 2.
Figure 4:
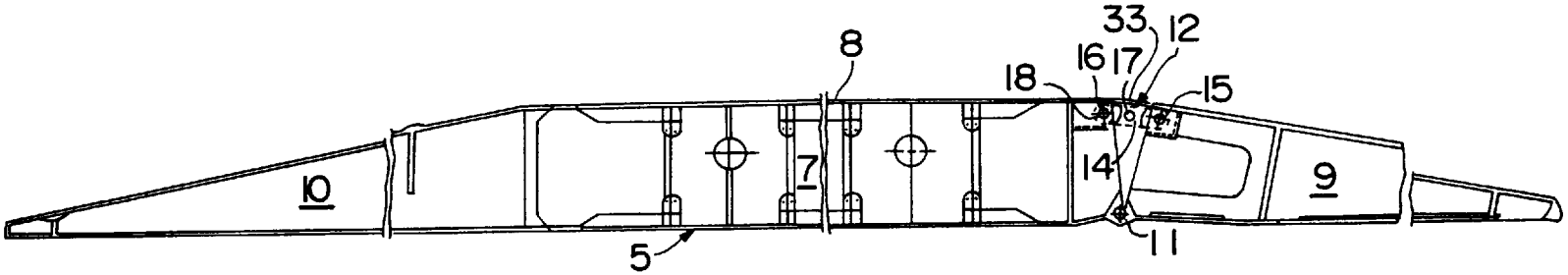
FIG. 4 is a view in section taken along line IV—IV of FIG. 2.
Figure 5:
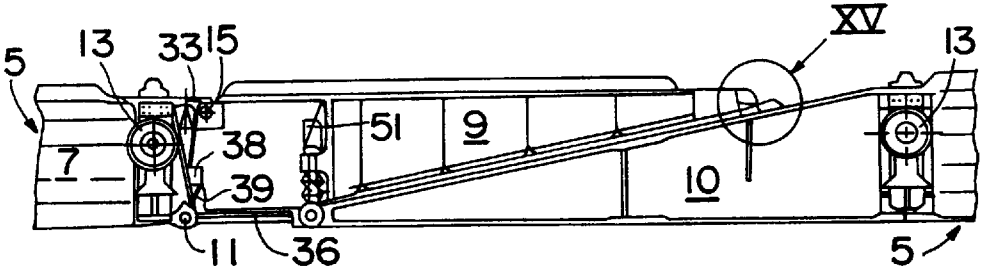
FIG. 5 is a side view partially showing two access jibs assembled upon each other of two partially shown different bridging span elements.
Figure 14:
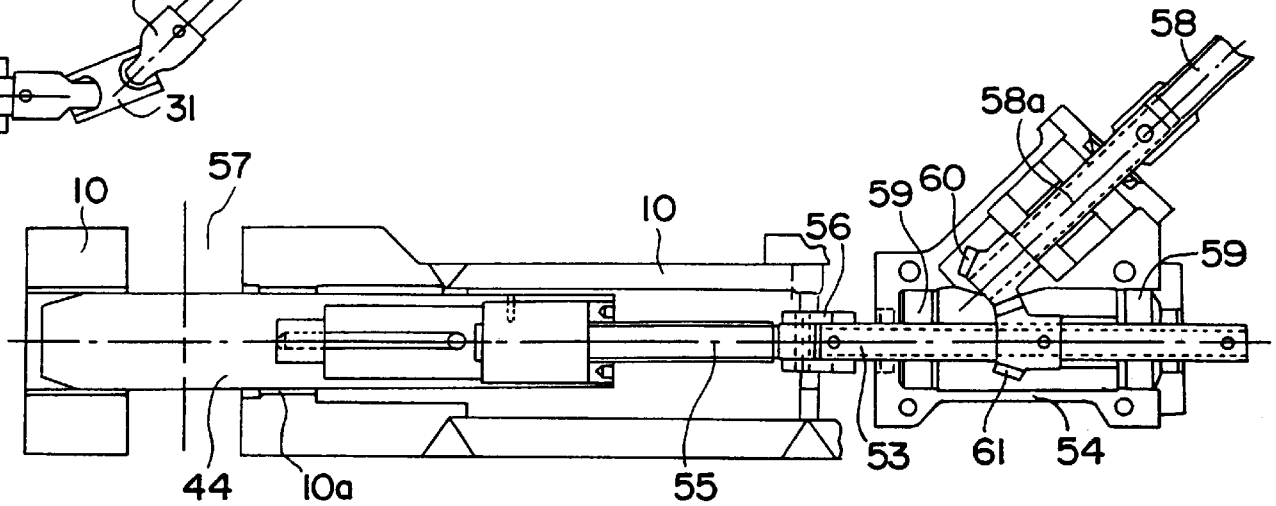
FIG. 14 is an enlarged view of the portion circled at XIV in FIG. 2.
Figure 15:
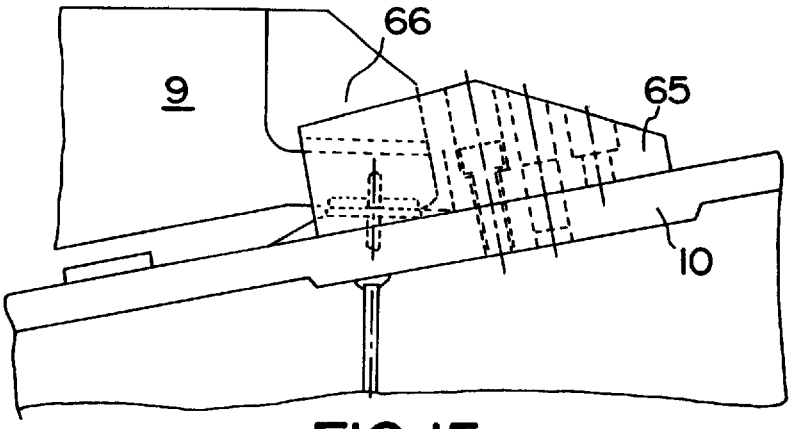
FIG. 15 is an enlarged view of the portion circled at XV in FIG. 5.
Figure 16:
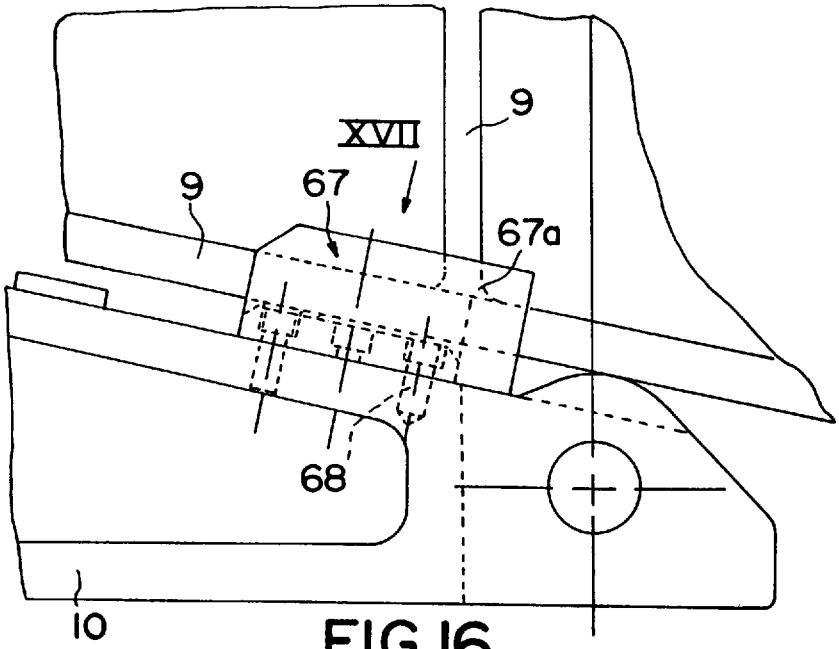
FIG. 16 is an enlarged view showing a stop for the transverse holding of the upwards swingable jib of one bridging span element in bearing relationship upon an adjacent stationary jib of another bridging span element.
Figure 17:
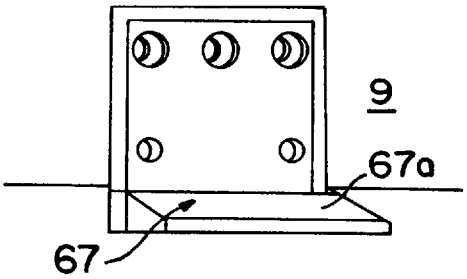
FIG. 17 is a top view of the stop according to the arrow XVII of FIG. 16.

As shown in FIGS. 2 and 14, the means for operating the displacement of both transverse shafts 44 of the stationary access jib 10 are similar to those permitting the displacement of the transverse locking shafts 16 and thus comprise a transverse shaft 53 rotatably mounted in a casing 54 made fast to the end of the stationary jib 10, two threaded rods 55 made fast to both ends, respectively, of the rotary shaft 53 in coaxial relation to the latter through the medium of a coupling sleeve 56 and onto each one of which is assembled an internally tapped sleeve constituting a transverse locking shaft 44, and a drive means for rotating the rotary shaft 53 so as to displace in translation in opposite directions both shafts 44 slidably mounted in their respective bores 10*a* of the stationary access jib 10 from a position of unlocking to a position of locking of the end of the stationary access jib 10 from and to both bushes 43 for the connection of the horizontal link 36 and the vertical link 41 of the adjacent upwards swung access jib. When the raised jib 9 of a bridging span element 5 is properly presented to the stationary jib 10 of another bridging span element 5 for their being assembled, both bushes 43 are respectively engaging two longitudinal clevis-like openings 57 at the end of the stationary jib and on either side of the latter.

The drive means for rotating the rotary shaft 53 comprises a drive rod 58 extending obliquely through the structure of the stationary access jib 10 and an end portion 58*a* of which is rotatably mounted in the supporting casing 54 of the shaft 53 by two bearings 59, for example of the needle bearing type and carries a bevel gear 60 meshing with another bevel gear 61 made fast to the rotary shaft 53, the other end 58*b* of the drive rod 58 being coupled through the medium of a coupling of the Cardan joint kind 62 to a shaft 63 rotatably mounted onto the stationary jib 10 towards the latter while facing the other bridging span element of the same bridging span 2, the shaft 63 carrying a side sprocket pinion 64 onto which is mounted a transmission chain (not shown) driven opposite from the sprocket pinion 64 by a drive sprocket pinion of a power member such as an electric motor made fast to the stationary jib 10.

Each stationary access jib 10 of a bridging span element 5 comprises two hook-like pyramid-shaped parallel portions 65 located on either side of the jib 10 oppositely from the end of this jib. These hook-like portions 65 are directed towards the end of the stationary jib 10 and are intended to engage two longitudinal notches 66, respectively, of an upwards swung jib 9 of another bridging span element 5 located at the end of the jib 9 on either side of the latter. Thus upon assembling both bridging spans, each hook-shaped portion 65 of a stationary access jib 10 of a bridging span engages the corresponding notch 66 of the upwards swingable jib 66 of the other bridging span so as to transversely connect these two bridging spans. The pyramid-like shape of the hook-like portions makes them not very aggressive to the wheels of the vehicles and permits these portions to be easily cleaned.

The transverse connection between bridging spans is also provided by two right-angle side stops 67 fastened onto the upper portion of the stationary jib 10 by fastening screws 68 on either side of this jib somewhat behind openings 57 for receiving the bushes 43. In the assembled position of the bridging spans, both corresponding edges of an upwards swung jib 9 are caused to bear upon both straight walls 67*a*, respectively, of the stop 67 to thus hold the upwards swung access jib 9 transversely.

Figure 7:
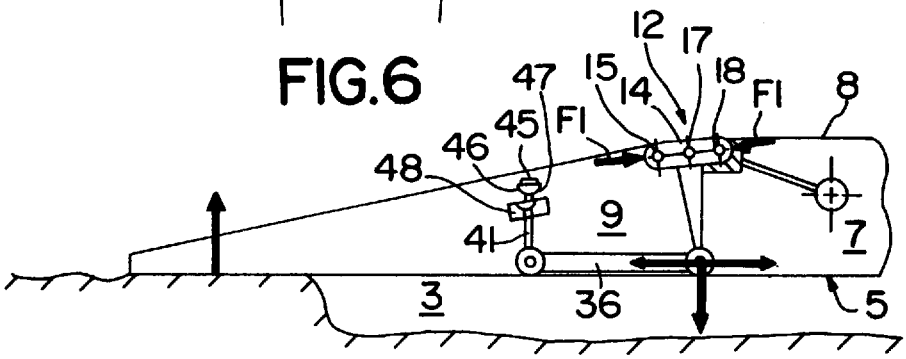
FIG. 7 is a partial view of a bridging span element showing the different components of forces applied to the end of the bridging span element bearing upon one edge of a ditch.

FIG. 7 shows the upwards swingable jib 9 of a bridging span element 5 of a bridging span 2 bearing upon the edge or the bank of a bridge 3 and locked in the lower position by upper locking means 12. This figure shows that the components of forces which exert themselves upon this end portion of the bridging span element 5 are such that the tie-rod elements 14 of the locking means 12 are working in compression as shown by both arrows F1. Owing to the fact that the upwards swingable jib 9 assumes its lower position, each nut 45 with a spherical bearing surface 46 is disengaged from its corresponding supporting base 48 as FIG. 7 clearly shows this.

Figure 8:
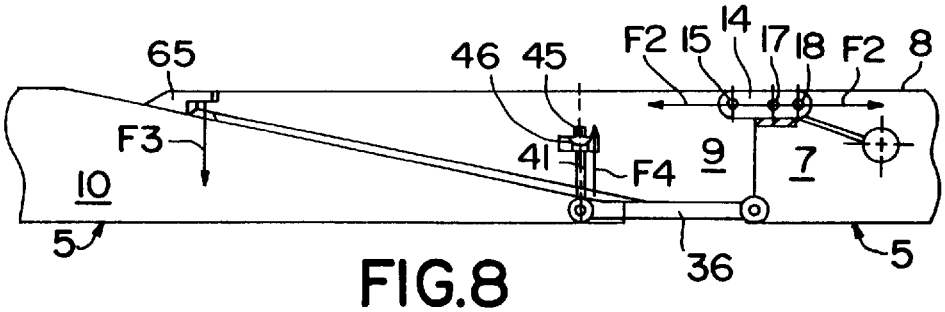
FIG. 8 shows the components of forces applied to both jibs of two different assembled bridging span elements during the launching of these two bridging span elements over a ditch as shown in FIG. 1.

FIG. 8 shows the situation according to which two bridging span elements 5 of two different bridging spans are assembled together by the locking means comprising the horizontal link 36 and vertical link 41 and the bushes 43 on both sides of the jib 9 locked in the upwards swung position by the tie-rod elements 14 and the locking shafts 44 inserted into both bushes 43, respectively, with both jibs 9 and 10 connected transversely by the hook-shaped stops 65 and the side stops 67. When launching both thus assembled bridging spans 2 by the vehicle 1 as shown on FIG. 1, the tie-rod elements 14 are working in traction as shown by both arrows F2 and the bending moment created by the own weight of each bridging span is taken up on either side of each bridging span element 5 by the vertical forces F3 and F4, respectively, at the end of the stationary jib 10 (linear bearing) and at the end of the upwards swingable jib 9 (stops 65). In this situation, the horizontal links 36 and the vertical links 41 and the bushes 43 only provide the connection in the horizontal direction between both bridging spans 2 to the exclusion of any other force. These links are free to move up again and owing to this fact, the end of the stationary jib 10 is bearing underneath the upwards swung jib 9 and the elastic stops 38 and spherical stops 42 allow a side excursion motion of both links 36, 41 removing or limiting the transmission of side forces so that these two links only undergo compression or tension forces exclusive of bending forces, the bridging span being of course connected transversely by the stops 65 and 67.

Figure 9:
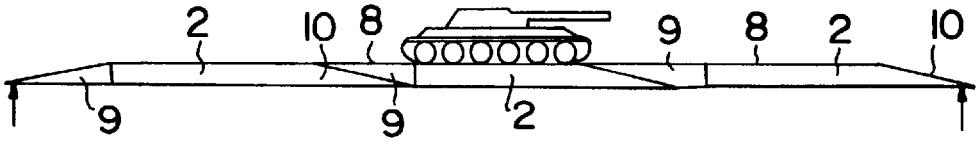
FIG. 9 shows the passage of a vehicle over several bridging spans assembled end-to-end and laid down above a ditch.
Figure 10:
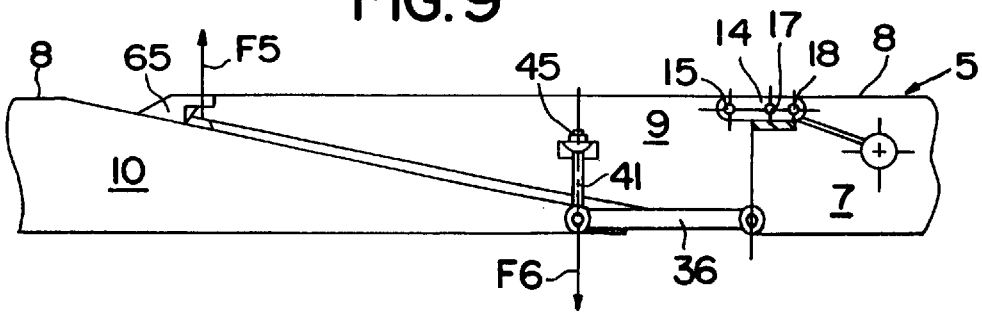
FIG. 10 shows the components of forces applied to both jibs of two different bridging span elements during the passage of the vehicle as shown in FIG. 9.

During the passage of vehicles over at least two assembled bridging spans 2 as shown on FIG. 9, the upper locking means are no longer acted upon owing to the clearance between the bores 17 and transverse locking shafts 16 of the locking means 12 and the compression forces pass directly from the upwards swung jib 9 to the central box 7 through the medium of the bearing front faces of the upwards swung jib 9 and of the central box 7, respectively, as shown in FIG. 10. This figure also shows that the bending moment created during the passage of vehicles resolves itself into vertical forces F5 and F6 located at the end of the upwards swung jib 9 linearly bearing upon the stationary jib 10 and the end of the stationary jib 10 taken up by the vertical links 41, respectively.

The essential advantages of the locking means described hereinabove of the invention consist in the reduction of the forces at the interface areas between bridging span elements 5 and the reduction of the forces upon the hinge 11 for the pivotal connection of an upwards swingable jib 9 to the central box 7.

What is claimed is:

1. A bridging span structure for the crossing of ditches by vehicles, including at least one bridging span element comprising a central rigid box with an upper treadway and two access jibs assembled to both ends, respectively, of the central box so as to extend the treadway of the central box, one of the access jibs being fastened to the central box by a transverse pivot pin and by unlockable locking means allowing the access jib to assume a lower position bearing upon one edge of a ditch or an upper or upwards swung position of coupling to an access jib of another bridging span element, wherein the locking means comprise at least two elements forming parallel tie-rods disposed symmetrically to the longitudinal axis of the bridging span element and pivotally connected to the upwards swingable access jib by two stationary transverse pins, and two first transverse locking shafts with a controlled displacement permitting both tie-rod elements to be fastened to the central box in two different positions corresponding to the lower and upwards swung positions, respectively, of the upwards swingable access jib.

2. A bridging span structure according to claim 1, wherein the transverse pivot pin of the upwards swingable access jib is located at a lower portion thereof and the locking means of the access jib are located at an upper portion of the upwards swingable access jib and of the central box.

3. A bridging span structure according to claim 1, wherein the first transverse locking shafts are movably mounted in two bores, respectively, of the central box and may be each inserted into one of two bores of the corresponding tie-rod element defining both lower and upwards swung positions of the access jib.

4. A bridging span structure according to claim 3, wherein the first transverse locking shaft of one corresponding tie-rod element extends through the bore defining the raised position of the upwards swingable access jib with a clearance allowing bearing front faces of the access jib and of the central box to be brought into end-to-end engagement during the passage of vehicles over the bridging span element.

5. A bridging span structure according to claim 1, wherein each of the first transverse locking shafts comprises an internally tapped sleeve, the bridging span structure including means for controlling the displacement of both first transverse locking shafts comprising a transverse rotary shaft rotatably mounted in a casing made fast to the central box, two threaded rods made fast to opposite ends of the rotary shaft in coaxial relation thereto and onto each one of which is assembled one of the internally tapped sleeves, and a drive means for rotating the rotary shaft so as to displace in translation in opposite directions both sleeves from an unlocking position to a locking position of the tie-rod elements.

6. A bridging span structure according to claim 5, wherein the drive means for rotating the rotary shaft comprises a drive rod extending through the central box and a first end portion of which is rotatably mounted in the casing supporting the rotary shaft and carries a bevel gear meshing with another bevel gear made fast to the rotary shaft, a second end portion of the drive rod being mechanically coupled to a sprocket pinion rotatably mounted onto the central box on one side of the latter and driven by a transmission chain.

7. A bridging span structure according to claim 6, wherein the second end portion of the drive rod is coupled to the sprocket pinion by a Cardan joint.

8. A bridging span structure according to claim 1, further comprising means for locking the upwards swingable access jib of the bridging span element onto a stationary access jib of another adjacent bridging span element for assembling both bridging span elements together and comprising on either transverse side of the upwards swingable access jib, a horizontal link mounted onto one of the transverse pivot pins of the upwards swingable access jib through a ball-and-socket pivot joint and fastened to the central box through an elastic stop, a vertical link connected to the upwards swingable jib through a spherical stop and to the horizontal link through a bush permitting the passage of a controlled slidable second transverse locking shaft disposed on one side of the stationary access jib of the other bridging span element at the end of the latter, so that in the position of the upwards swung access jib of the bridging span element locked onto the stationary access jib of the other bridging span element, each spherical stop and each elastic stop absorb side forces exerted upon the assembled bridging span elements during launching of these elements over a ditch and each vertical link takes up vertical forces located at and applied to the end of the stationary access jib during passage of vehicles over the assembled bridging span elements.

9. A bridging span structure according to claim 8, wherein the spherical stop comprises a nut with a spherical bearing surface screwed onto a threaded end of the vertical link and bearing upon a complementary spherical surface of a base fastened onto a supporting portion made fast to the upward swingable jib, an upper portion of the vertical link extending through the supporting portion and the base.

10. A bridging span structure according to claim 8, wherein the elastic stop is fastened between the central box and a radial lug made fast to the horizontal link at the level of its pivotal connection to the central box.

11. A bridging span structure according to claim 8, wherein each of the second transverse locking shafts comprises an internally tapped sleeve, the bridging span structure including means for controlling the displacement of both second transverse locking shafts of the stationary access jib of a bridging span element comprising a transverse rotary shaft rotatably mounted in a casing made fast to the end of the stationary jib, two threaded rods made fast to opposite ends of the rotary shaft in coaxial relation to the latter and onto each one of which is assembled one of the internally tapped sleeves, and a drive means for rotating the rotary shaft so as to displace in translation in opposite directions both sleeves from a position of unlocking to a position of locking of the end of the stationary access jib from and to both connecting bushes of both horizontal and vertical links of the upwards swung access jib.

12. A bridging span structure according to claim 11, wherein the drive means for rotating the rotary shaft comprises a drive rod extending through the stationary access jib and a first end portion of which is rotatably mounted in a casing supporting the rotary shaft and carries a bevel gear meshing with another bevel gear made fast to the rotary shaft, and a second end portion of the drive rod being mechanically coupled to a sprocket pinion rotatably mounted onto the stationary jib on one side thereof and driven by a transmission chain.

13. A bridging span structure according to claim 12, wherein the second end portion of the drive rod is coupled to the rotary shaft of the side sprocket pinion by a Cardan joint.

14. A bridging span structure according to claim 1, wherein the end of the upwards swingable access jib of the bridging span element is fastened to the stationary access jib of the other bridging span element by two parallel hook-shaped portions made fast to the stationary access jib in the vicinity of edges thereof and engaging two longitudinal notches formed at the end of the upwards swingable access jib.

15. A bridging span structure according to claim 1, wherein the stationary access jib of the other bridging span element comprises two right-angle side stops made fast to the end of the stationary access jib and transversely holding the corresponding portion of the upwards swung access jib in bearing relationship upon the stationary access jib in the assembled position of both bridging span elements.

16. A bridging span structure according to claim 1, comprising two bridging span elements with parallel upper treadways and the central boxes of which are connected to each other by two connecting arms and wherein one jib of each of the bridging span elements is stationary and another jib of each bridging span element is upwards swingable.

17. A bridging span structure according to claim 1, wherein the bridging span structure is capable of being crossed by armored vehicles.

* * * * *